US012696967B2

(12) United States Patent
Thorez et al.

(10) Patent No.: US 12,696,967 B2
(45) Date of Patent: Aug. 4, 2026

(54) REFILL AND POT FOR PACKAGING A COSMETIC PRODUCT COMPRISING SUCH A REFILL

(71) Applicant: ALBEA SERVICES, Gennevilliers (FR)

(72) Inventors: Gaël Thorez, Gennevilliers (FR); Alain Pagneux, Gennevilliers (FR)

(73) Assignee: Albea Services, Courbevoie (FR)

( * ) Notice: Subject to any disclaimer, the term of this patent is extended or adjusted under 35 U.S.C. 154(b) by 57 days.

(21) Appl. No.: 18/376,953

(22) Filed: Oct. 5, 2023

(65) Prior Publication Data

US 2024/0115029 A1 Apr. 11, 2024

(30) Foreign Application Priority Data

Oct. 6, 2022 (FR) ..... 2210234

(51) Int. Cl.
*A45D 34/00* (2006.01)
*A45D 33/00* (2006.01)
*B65D 77/04* (2006.01)

(52) U.S. Cl.
CPC ..... *A45D 34/00* (2013.01); *A45D 33/00* (2013.01); *B65D 77/0493* (2013.01); *A45D 2034/005* (2013.01)

(58) Field of Classification Search
CPC ..... A45D 2034/005; A45D 40/0068; A45D 40/00; B65D 21/0233
USPC ..... 215/12.1; 206/514
See application file for complete search history.

(56) References Cited

U.S. PATENT DOCUMENTS 2,575,283 A * 11/1951 Menrath ..... B65D 77/0493 215/12.1
11,840,374 B2 * 12/2023 Bungard ..... B65D 41/165
2017/0232318 A1 * 8/2017 Topolosky ..... B65D 21/0233 220/737

FOREIGN PATENT DOCUMENTS

FR 3037488 A1 * 12/2016 ..... A45D 40/00
KR 102109199 B1 5/2020

OTHER PUBLICATIONS

FR2210234, "Novelty Search Report", May 9, 2023, 8 pages.

* cited by examiner

*Primary Examiner* — Anthony D Stashick
*Assistant Examiner* — Raven Collins
(74) *Attorney, Agent, or Firm* — Morgan, Lewis & Bockius LLP

(57) ABSTRACT

The invention relates to a refill for a pot for packaging a cosmetic product, extending along a central axis X, suitable for receiving the cosmetic product, and comprising a rigid body defined by a peripheral wall having an open upper end surrounded by a collar extending outwards, and a lower end closed by a bottom wall. This refill comprises wedging means for wedging in the pot, which are deformable and define, with an outer surface of the peripheral wall, at least one cavity with a volume that varies as a function of the wedging.

11 Claims, 8 Drawing Sheets

[Fig.1]
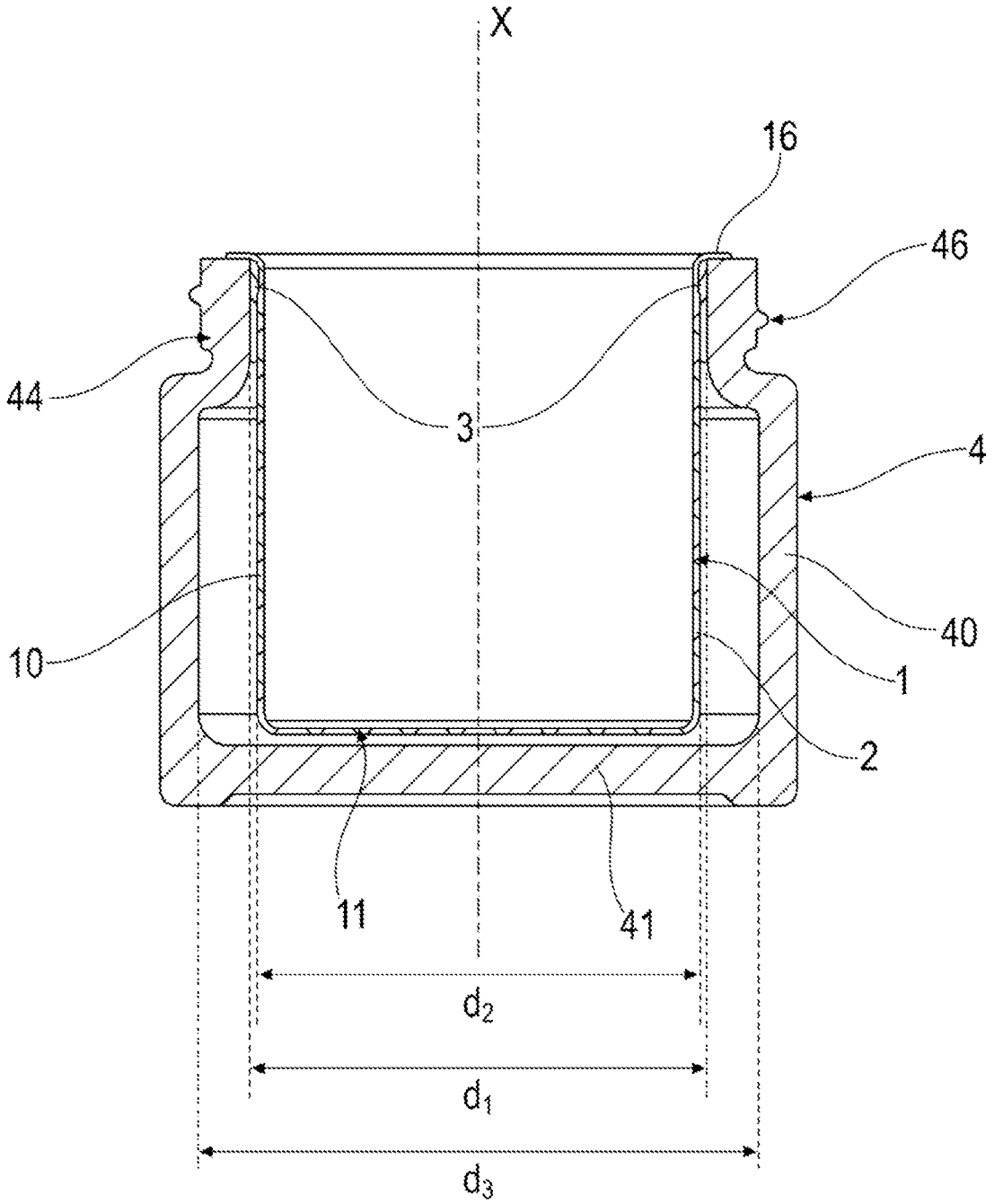

[Fig.2]
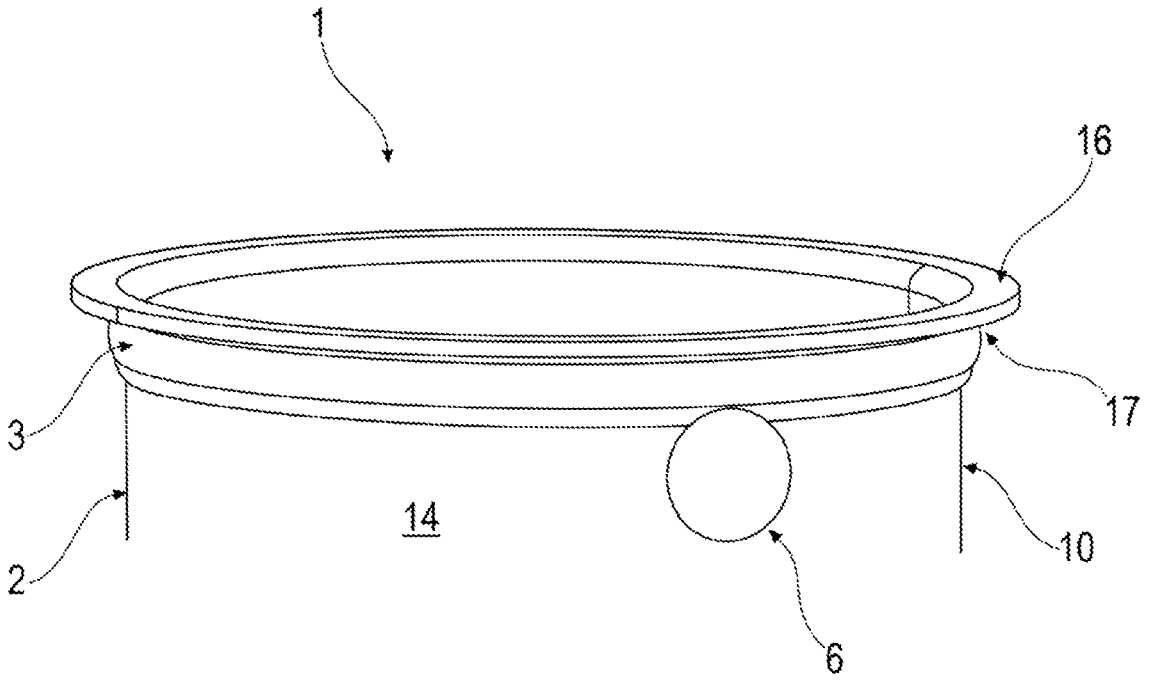

[Fig.3]
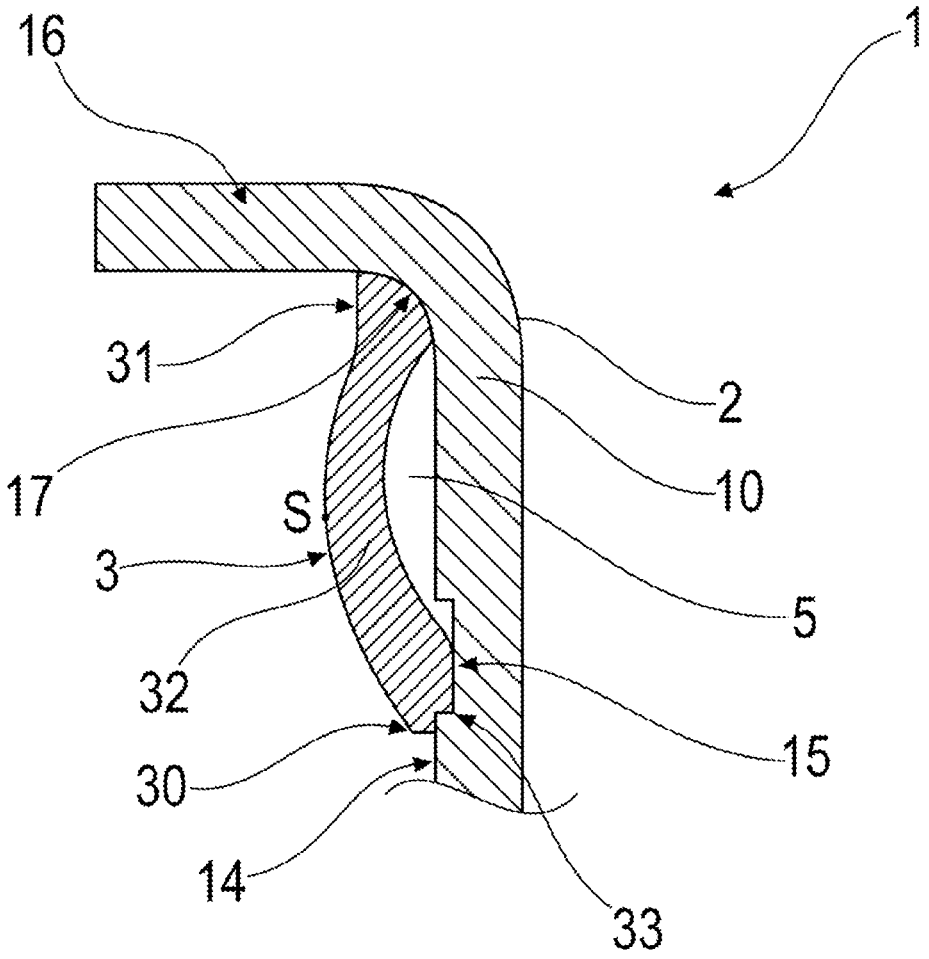

[Fig.4]
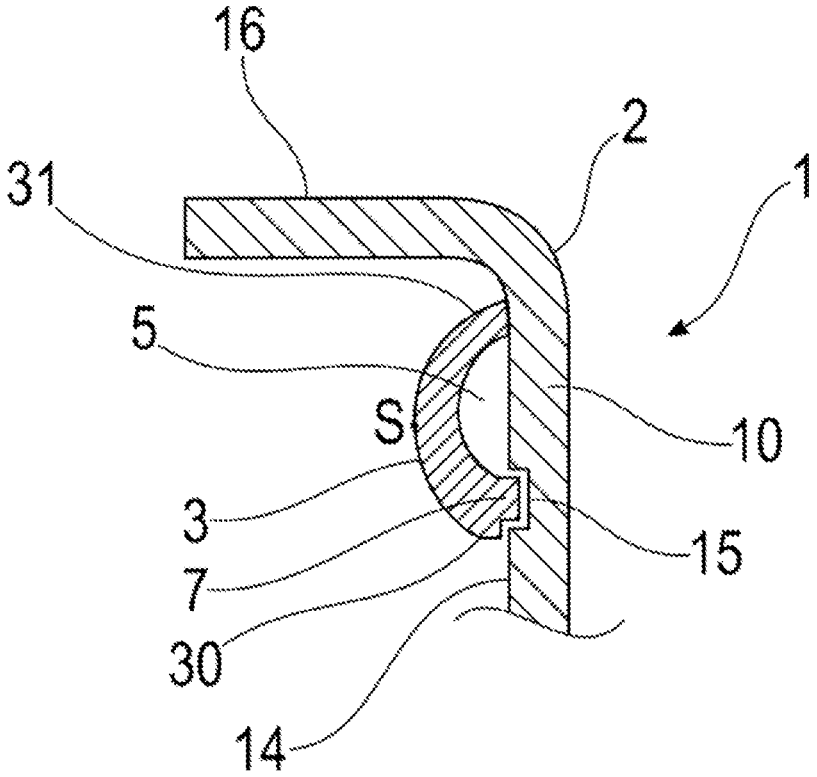

[Fig.5]
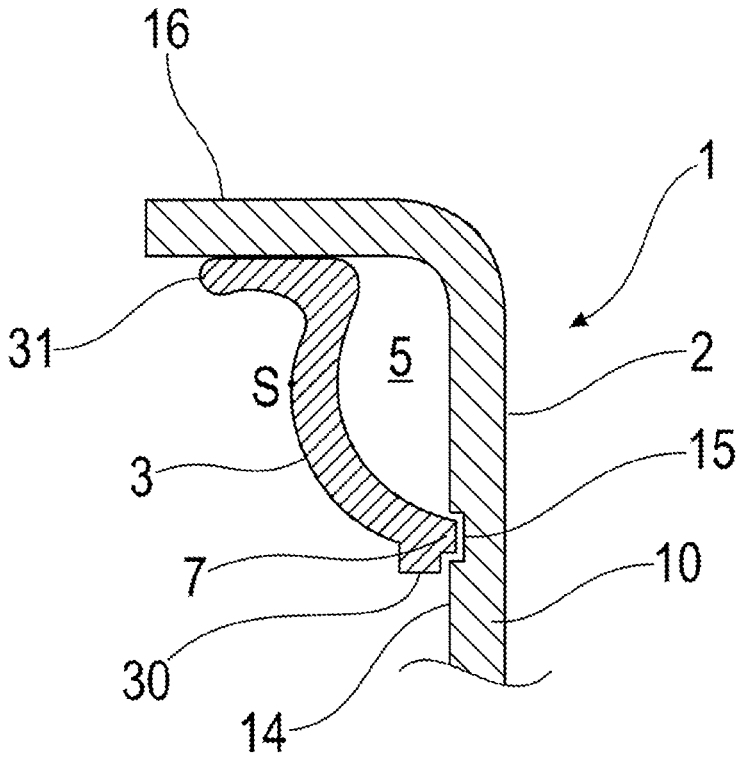

[Fig.6]
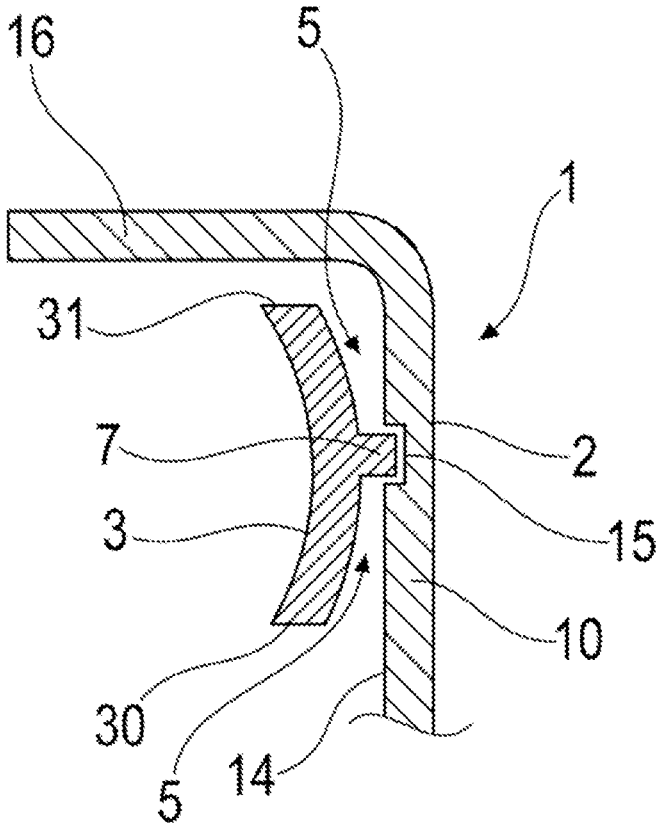

[Fig.7]
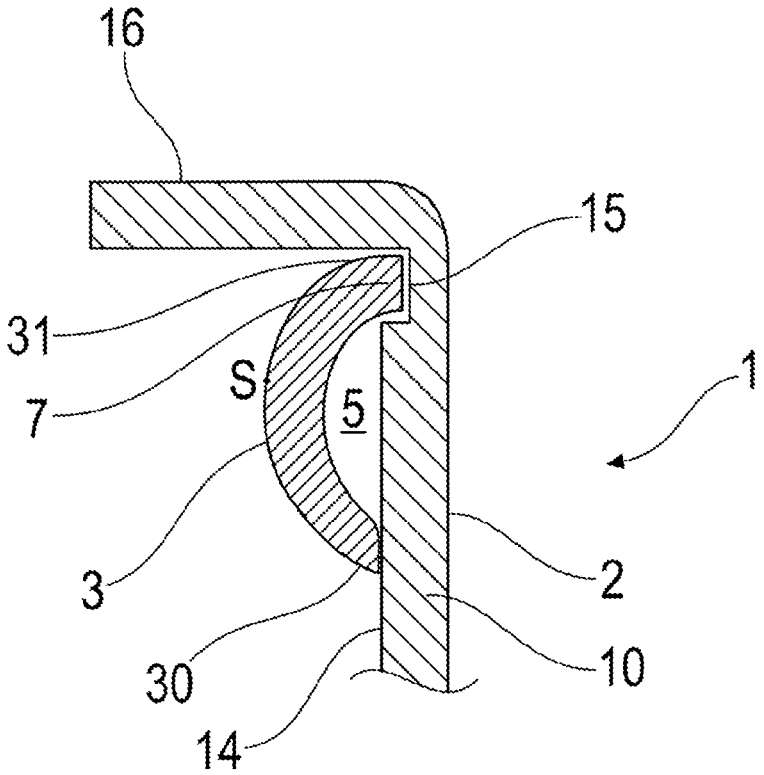

[Fig.8]
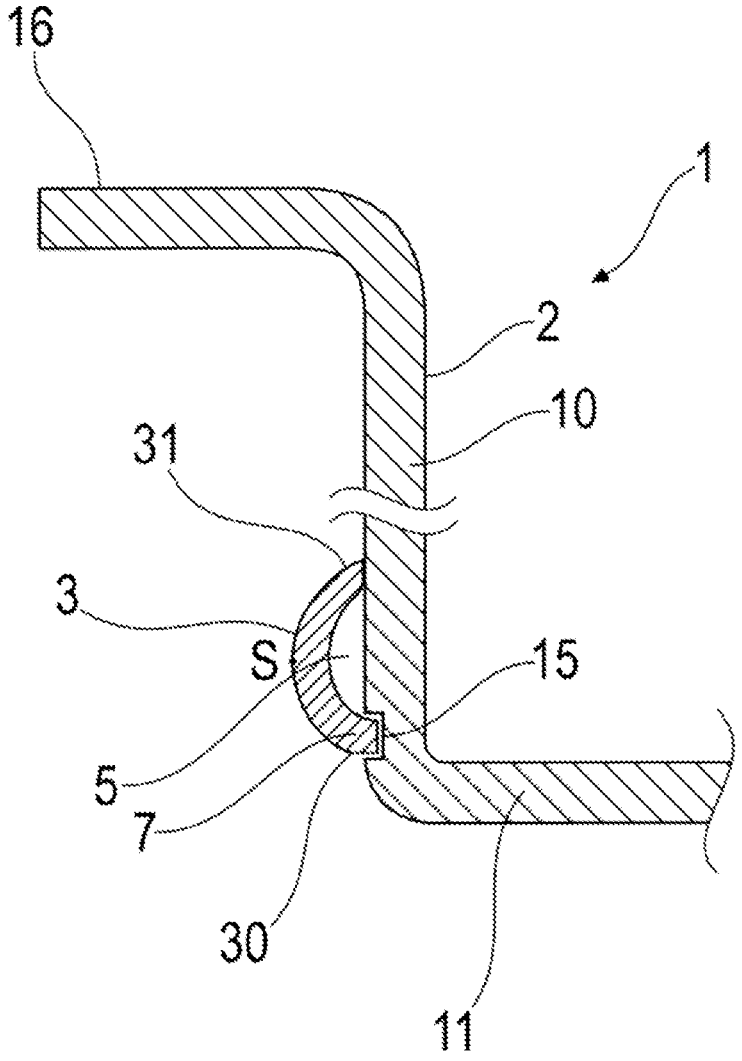

REFILL AND POT FOR PACKAGING A COSMETIC PRODUCT COMPRISING SUCH A REFILL

CROSS-REFERENCE TO RELATED APPLICATION

This application claims priority to French Application No. 2210234, filed Oct. 6, 2022, the contents of which are incorporated herein by reference in their entirety.

TECHNICAL FIELD OF THE INVENTION

The invention relates to a refill for a pot for packaging a cosmetic product. The invention also concerns a pot for packaging a cosmetic product comprising such a refill.

TECHNICAL BACKGROUND

The pots for packaging a cosmetic product consist of an assembly typically comprising a receptacle and a refill containing the cosmetic product. The refill is generally designed so that it can be placed removably in the receptacle. Thus, when the refill is empty, it can be either discarded or refilled with cosmetic product. The cosmetic product is therefore not contained directly in the receptacle but in the refill.

The receptacles used in the pots for packaging cosmetic product can come in a wide variety of shapes and sizes, which are not always adapted to those of the refill that the receptacles are designed to hold. In this respect, the prior art has focused on finding ways of adapting and/or maintaining the refill in the receptacle.

The document FR 3108588 discloses a pot for packaging a cosmetic product, comprising a receptacle 8 and a refill 1 suitable for insertion into the receptacle. In order to reduce the clearance between the receptacle and the refill, the pot is equipped with an elastomeric element 15 intimately bonded to an inner wall of the receptacle so as to project from said inner wall. The elastomeric element 15 is in the form of an annular strip moulded onto the upper portion of the receptacle. The annular strip may be equipped with studs 16 to ensure that the refill 1 is correctly positioned in the receptacle.

While the clearance between the receptacle and the refill is reduced or even non-existent in this type of pot, it is not practical. The elastomeric element 15 must be rigorously attached to the inner wall of the receptacle to prevent it becoming detached after several refills. If it becomes detached from the inner wall, the pot is no longer usable and must be disposed of. In addition, as the elastomeric element is over-moulded onto the receptacle, the latter must be made from a material compatible with the over-moulding, which limits the choice of materials. When the receptacle is made of plastic, the elastomeric element and the receptacle can be formed by bi-material injection moulding. However, this method is complex because it requires a precise adjustment of the alignment between the machines injecting the materials in order to obtain a good quality superposition.

The document FR 3108584 discloses a pot for packaging a cosmetic product, comprising a receptacle 13 and a refill 1 suitable for insertion into the receptacle. Unlike the document FR 3108588, the elastomeric element 8 is over-moulded onto the refill 1, in particular onto a cylindrical bucket 2 of the refill, instead of being over-moulded onto the receptacle 13. The elastomeric element 8 is in the form of a plurality of strips, in this case three strips, arranged regularly around the entire circumference of the bucket 2. Each strip protrudes from an outer surface of the bucket and comprises an end adjacent to an upper border of the bucket 2. These ends can be covered by a stud 9, also projecting from the outer surface, which holds the refill in the receptacle.

As in the document FR 3108588, the use of an elastomeric element directly moulded onto the refill limits the choice of materials that can be used for the refill and/or complicates the manufacturing method for manufacturing the refill. Moreover, other issues arise in this case. This is because the refill cannot be integrated into a single-material recycling system when it is made of two different materials. However, unlike the receptacle, it is intended to be used as a consumable which, in the long term, can generate a large quantity of waste that is difficult to use. In addition, the presence of the strips of the elastomeric element all around the bucket makes the bucket unsightly. The appearance of the refill is important because the user associates it with the value of the cosmetic product it contains. An unattractive refill depreciates the value of the product it contains.

The invention allows to overcome at least some of the above problems.

SUMMARY OF THE INVENTION

In this respect, the invention proposes a refill for a pot for packaging a cosmetic product extending along a central axis X, capable of receiving the cosmetic product, and comprising a rigid body defined by a peripheral wall having an open upper end surrounded by an outwardly extending collar, and a lower end closed by a bottom wall.

The main characteristic of this refill is that it comprises wedging means for wedging in the pot, which are deformable and define, with an outer surface of the peripheral wall, at least one cavity whose volume varies as a function of the wedging.

The main idea behind this invention is to use the volume of the cavity to wedge the refill into the receptacle of the pot. At rest, i.e. when the refill is not yet inserted in the receptacle, the volume is at its maximum. In the working position, i.e. when the refill is inserted in the receptacle, the volume is minimal.

When the refill is inserted into the receptacle, the wedging means are compressed to a greater or lesser extent and therefore deformed on contact with the receptacle, depending in particular on the clearance between the refill and the receptacle. The greater the compression, the smaller the volume of the cavity. This variation in the volume of the cavity allows to absorb the existing clearance while maintaining a contact between the refill and the receptacle via the deformation of the wedging means.

The compression applied to the periphery of the refill can be greater or lesser, as this depends not only on the clearance, but also on the dimensional variations of both the refill and the receptacle.

According to various characteristics of the invention which may be taken together or separately:

- said wedging means consist of at least one external, flexible wedging wall arranged opposite and at least partially spaced from the external surface of the peripheral wall, said cavity being defined between the wedging wall and the peripheral wall.
- each wedging wall is curved.
- each wedging wall is mounted on the peripheral wall by interlocking corresponding shapes.

the peripheral wall comprises a female form embodied in its outer surface, into which a male form provided for this purpose interlocks on the wedging wall.

each wedging wall has an inwardly curved shape with a summit disposed in contact with the peripheral wall of the bucket, said male shape projecting from the summit of the wedging wall.

each wedging wall has an outwardly curved shape with a summit spaced from the peripheral wall of the bucket, said male shape projecting from a lower end of the wedging wall.

each wedging wall has an upper end in contact with the body.

the upper end of the wedging wall rests against the collar.

the upper end of the wedging wall rests on the outer surface of the peripheral wall, in the vicinity of the collar.

the upper end of the wedging wall rests in the angle formed between the peripheral wall and the collar.

the refill comprises a single wedging wall extending around the entire upper periphery of the body.

the wedging wall consists of a removable ring.

the refill comprises several wedging walls evenly distributed around the body.

each wedging wall extends over an angular sector of the body.

the body and the wedging wall or walls are made of the same material.

The invention also relates to a pot for packaging a cosmetic product comprising a receptacle and a refill, as described above, inserted into the receptacle, the wedging means being wedged against the receptacle so as to absorb the clearance existing between the refill and the receptacle.

BRIEF DESCRIPTION OF THE FIGURES

Further objects, characteristics and advantages of the invention will become clearer in the following description, made with reference to the attached figures, in which:

FIG. 1 is a cross-sectional view of a packaging pot equipped with a refill according to a first embodiment of the invention;

FIG. 2 is a perspective view of the upper portion of the receptacle in the first embodiment;

FIG. 3 is an enlarged cross-sectional view of the upper left-hand portion of the receptacle shown in FIG. 2;

FIG. 4 is an enlarged cross-sectional view of the upper left-hand portion of a receptacle according to a $2^{nd}$ embodiment of the invention;

FIG. 5 is an enlarged cross-sectional view of the upper left-hand portion of a receptacle according to a $3^{rd}$ embodiment of the invention;

FIG. 6 is an enlarged cross-sectional view of the upper left-hand portion of a receptacle according to a $4^{th}$ embodiment of the invention;

FIG. 7 is an enlarged cross-sectional view of the upper left-hand portion of a receptacle according to a $5^{th}$ embodiment of the invention;

FIG. 8 is an enlarged cross-sectional view of the left-hand portion of a receptacle according to a variant of the $2^{nd}$ embodiment of the invention.

DETAILED DESCRIPTION OF THE INVENTION

In the following description, elements with identical structure or similar functions will be designated by same references.

By convention, the "axial" direction corresponds to the main extension of the pot, illustrated by the axis X in FIG. 1, and the "radial" direction is orthogonal to the axial direction.

In the following detailed description of the figures, the terms "upper" and "lower" or "top" and "bottom" will be used without limitation in reference to the axial direction. Similarly, the terms "outer or external" and "inner or internal" are used with reference to the radial direction, an outer element being radially further from the axis X than an inner element.

With reference to FIG. 1, the invention relates to a cosmetic product packaging pot comprising a receptacle 4 and a refill 1 inserted into the receptacle 4.

The refill 1 corresponds to a bucket and contains the cosmetic product. The refill is removable and can be manually removed from the packaging pot, particularly when it is empty, so that the user can insert a new, filled refill. The refill 1 and the receptacle 4 can therefore be sold separately.

In one embodiment of the invention, the receptacle 4 is rigid. As well as giving it improved mechanical strength, this also means it lasts longer. As a non-limiting example, the receptacle can be made of glass. It is thus possible to obtain a packaging pot with an attractive appearance by taking advantage of both the transparency of the glass receptacle 4 and the aesthetic appearance of the refill 1.

The receptacle 4 comprises a body 40 topped by a neck 44. The receptacle 4 is open at the upper portion and closed at the lower portion by a bottom 41.

In this example, the receptacle 4 has a constriction at the level of the neck 44, i.e. the inner diameter d1 of the neck 44 is smaller than the inner diameter d3 of the body 40. However, a receptacle 4 with a neck 44 having an inner diameter d1 identical to the diameter d3 of the body 40 also falls within the scope of the present invention.

As illustrated in FIG. 1, the neck 44 has an inner diameter $d_1$ which is greater than the outer diameter $d_2$ of the refill 1 in order to provide a clearance for insertion of the refill 1 into the receptacle 4.

Similarly, if the neck 44 and the body 40 had the same inner diameter d1, d3, the latter would be smaller than the outer diameter d2 of the refill 1 to allow easy insertion.

The neck 44 has attaching means 46 for attaching a cover (not shown) allowing to close the packaging pot once the refill 1 has been positioned in the receptacle. The attachment means 46 may consist, for example, of an external thread cooperating with an internal thread provided in the cover.

The refill 1 contains the cosmetic product, which may be fluid, particularly liquid or viscous, or may be powdery, for example. It is therefore sold to the end user hermetically sealed, which allows to protect the cosmetic product from the outside environment. This sealed closure is usually carried out by means of a lid. Once the lid has been removed by the user and the refill 1 has been inserted into the receptacle 4, the cover of the receptacle closes the packaging pot and ensures that the cosmetic product is preserved away from the outside environment.

The refill 1 comprises a rigid body 2 defined by a peripheral wall 10 having an open upper end surrounded by a collar 16 extending outwards from the refill 1, and a lower end closed by a bottom wall 11.

As illustrated in the figures, the peripheral wall 10 is substantially cylindrical in shape. This being said, the shape of the peripheral lateral wall 10 is not limited to the illustrated embodiment. It may take any other desired form, provided that it does not depart from the inventive concept underlying the present invention.

The upper portion of the refill 1 is illustrated in FIG. 2. The peripheral wall 10 and the collar 16 are clearly visible. There is therefore an angle 17 between the peripheral lateral wall 10 and the collar 16. This angle 17 is preferably between 45° and 135° C.

In the example shown, the collar 16 is oriented substantially perpendicular to the axis X. For example, the angle 17 is 90° C. The collar 16 rests on the upper rim of the neck 44 of the receptacle 4 when the refill 1 is inserted.

The peripheral wall 10 has an inner surface and an outer surface 14. The inner surface and the bottom 11 delimit an internal volume of the body 2 designed to receive the cosmetic product. As shown in FIG. 1, the outer surface 14 is intended to face an inner surface of the receptacle 4.

As also illustrated in all the figures, the refill 1 according to the invention comprises, in addition to the body 2, wedging means allowing to ensure that it is wedged and therefore held in the receptacle 4.

These wedging means cooperate with the outer surface 14 of the peripheral wall 10. They are deformable, and define at least one cavity 5 with a variable volume depending on the wedging.

The wedging means consist of at least one external, flexible wedging wall 3, arranged opposite and at least partially at a distance from the external surface 14 of the peripheral wall 10. The cavity 5 is defined between the wedging wall 3 and the peripheral wall 10.

The volume of air in the cavity 5 is variable, depending on the deformation undergone by the wedging wall 3. The closer the wedging wall 3 is to the peripheral wall 10, the smaller the volume. The volume of air is at its maximum when the wedging wall 3 is not under stress, in other words when the refill 1 is not inserted into the receptacle 4.

In concrete terms, as mentioned above, there is a functional clearance between the outer surface 14 of the refill 1 and the inner wall of the receptacle 4 (at the level of the neck 44 and/or of the body 40). This clearance corresponds to d1-d2, and/or d3-d2. This clearance allows an easy insertion of the refill 1 into the receptacle 4, but also has the disadvantage of having a refill 1 that moves around in the receptacle 4 when the user takes a cosmetic product. As the wedging wall 3 is offset from the outer surface 14 of the refill 1, it comes into contact with the inner wall of the receptacle 4 when the refill 1 is inserted, at the level of the neck 44 and/or at the level of the body 40 depending on their diameters and its position on the body 2. In this way, the wedging wall 3 presses against the receptacle 4, and deforms thanks to its flexibility and the presence of the cavity 5 located just behind it, the volume of which varies accordingly. The wedging wall 3 is then deformed and wedges the refill 1 in the receptacle 4. At the end of insertion, the refill 1 is wedged in place and does not move when the user comes to take the product. The wedging wall 3 compensates for the clearance between the refill 1 and the receptacle 4.

Preferably, the wedging wall 3 is curved to define the cavity and to deform more easily.

Generally speaking, the refill 1 may comprise a single wedging wall 3 that runs completely around the body 2, or it may comprise several wedging walls 3 that are distributed around the body 2.

In the case of a plurality of wedging walls 3, these are preferably evenly distributed around the body 2. They extend over a predefined angular sector. The wedging walls 3 thus form bosses on the refill 1.

In the case of a single wedging wall 3, this is similar to a ring surrounding the body 2.

The wedging wall 3 has a wedging function with the inside of the receptacle 4, and does not have a sealing function. If a seal is required, it will be made with the upper surface of the receptacle 4 and the cover.

There are several embodiments in which this wedging wall can be used, which will be described below.

In the 1$^{st}$ embodiment shown in FIGS. 1 to 3, there is a single wedging wall 3 corresponding to a ring. In this case, the wedging wall 3 is a part independent of the body 2, the whole forming the refill 1.

This ring 3 is arranged in the upper portion of the body 2, around a stretch of its peripheral wall 10. It is positioned just below the collar 16. When the refill 1 is inserted into the receptacle 4, the ring 3 is level with the neck 44.

FIG. 3 allows to provide a clearer view of this outwardly curved wedging wall 3.

The wedging wall 3 is mounted on the peripheral wall 10 by interlocking corresponding shapes. The peripheral wall 10 comprises a female form embodied in its outer surface 14, into which a male form provided for this purpose interlocks on the wedging wall 3. In this case, the female form consists of a groove 15 formed on the outer surface 14, in the thickness of the peripheral wall 10. And the male form projects from a lower end 30 of the wedging wall 3, and comes to interlock in the groove 15. In this case, the groove 15 is annular.

In one variant, the male form could correspond to the lower end 30 itself.

According to the invention, the wedging wall 3 is held both against the groove 15 and against the angle 17 formed between the peripheral wall 10 and the collar 16. The wedging wall 3 therefore rests stably against both the groove 15 and the angle 17, allowing to prevent it from moving axially with respect to the body 2, but allowing it to retain its ability to deform.

The positioning of the wedging wall 3 in relation to the body 2 is guaranteed even during the insertion of the refill 1 into the receptacle 4. Thanks to its stable supports, the wedging wall 3 does not move even if the insertion is a little hard. This being said, the wedging wall 3 is removable, and can therefore be removed from the body 2, provided that the user takes a voluntary action in this direction by pulling the wedging wall out of the groove 15. However, this goes beyond the normal use of the refill 1 and is not desired.

In addition, the wedging wall 3 allows to hold the refill 1 in the receptacle 4. This is due, on the one hand, to its deformable nature, which allows it to compensate for any clearance that may exist between the refill 1 and the receptacle 4 and, on the other hand, to the stability conferred on it by its stable support against both the annular groove 15 and the angle 17.

In addition, the wedging wall 3 acts as a brake when the refill 1 reaches its final position in the receptacle 4, as the wedging wall 3 is close to the upper end of the body 2, which is the last portion to enter the receptacle 4, thus allowing to slow down the axial movement of the refill 1 at the end of its travel. The final position of the refill 1 in the receptacle 4 is reached when the collar 16 rests on the neck 44 of the receptacle 4.

The wedging wall 3 has a generally curved shape with a concavity facing the body 2.

The wedging wall 3 comprises a lower end 30 resting on the annular groove 15, an upper end 31 resting on the angle 17, and a curved segment 32 connecting said lower 30 and upper 31 ends, the curved segment 32 comprising the concavity facing the body 2. In other words, the wedging wall 3 forms a boss on the refill 1. The summit S of the boss is located at a distance from the peripheral wall 10.

The curved segment 32 creates an air cavity 5 between the deformable ring 3 and the body 2. In this way, the air cavity 5 is delimited on the one hand by the inner surface of the wedging wall 3 and on the other hand by the outer surface 14 of the body 2 located opposite the concavity, over the entire circumference of the peripheral wall 10. The volume of this cavity 5 varies according to the stresses exerted on the wedging wall 3.

The wedging wall 3 is sufficiently flexible for the curved segment 32 to deform elastically as a result.

The stresses are exerted on the outer surface of the wedging wall 3 at the level of the curved segment 32.

The closer the summit S of the curved area 32 is to the body 2, the smaller the volume of the cavity 5. The volume of the cavity 5 is minimal when the refill 1 reaches its final position and an inner surface of the receptacle 4 rests against the wedging wall 3 and the compress.

The groove 15 is defined by a bottom delimited by two lateral walls, a lower one 33 and an upper one, oriented perpendicularly to the peripheral wall 10 of the body 2.

Preferably, a mechanical attachment is made between the lower end 30 of the wedging wall 3 and the groove 15.

It is said to be "mechanical" because it results from the male form projecting from the lower end 30 interlocks into the groove 15. The male form creates a first shoulder at the level of the lower end 30 of the wedging wall 3. And the lower lateral wall 33 of the groove 15 creates a second shoulder with the outer surface 14 of the body 2. In this case, the first shoulder is interlocking into the second shoulder. Other types of attachment can be envisaged without prejudice to the inventive concept behind the present invention.

Advantageously, the upper end 31 has a rounded shape that follows the contours of the angle 17. This makes support more reliable. This ensures that the wedging wall 3 is correctly positioned in relation to the body 2.

In this 1$^{st}$ embodiment, it would be entirely conceivable for there to be a plurality of wedging walls 3 distributed around the refill 1, rather than a single wedging wall 3 running around the refill 1.

In the 2$^{nd}$ embodiment shown in FIG. 4, the wedging wall 3 has the same characteristics as in the 1$^{st}$ embodiment, with the exception that its upper end 31 rests against the outer surface 14 of the peripheral wall 10 of the body 2, rather than in the angle 17. In this embodiment, the wedging wall 3 can be positioned at any height of the body 2, either at the upper portion, the lower portion as shown in FIG. 8, or the central portion. Of course, this will depend on the shape and dimensions of the receptacle 4, so that the wedging wall 3 rests against an inner surface of the receptacle 4 (neck 44 or body 40).

In the 3$^{rd}$ embodiment shown in FIG. 5, the wedging wall 3 has the same characteristics as in the 1$^{st}$ embodiment, with the exception that its upper end 31 rests against the collar 16, rather than in the angle 17. The shape of the wedging wall 3 is adapted accordingly, so that the upper end 31 has a sufficiently large bearing area against the collar 16.

In the 4$^{th}$ embodiment shown in FIG. 6, the wedging wall 3 is curved inwards. Its summit is in contact with the peripheral wall 10, and its lower and upper ends 30, 31 are free and at a distance from the peripheral wall 10. The cavity 5 is this time divided into two areas, an upper area located above the summit, and a lower area located below the summit, the two areas still being located between the wedging wall 3 and the peripheral wall 10.

The male form projects from the summit of the wedging wall 3, and interlocks into a female form, such as a groove 15, provided for this purpose in the peripheral wall 10 of the body 2, as described previously. In this case, there are no longer two supports against the body 2, but a single support at the summit of the wedging wall 3.

The free ends 30, 31 will come into contact with the inner wall of the receptacle 4 to ensure the wedging.

In the 5$^{th}$ embodiment shown in FIG. 7, the wedging wall 3 has the same characteristics as in the 1$^{st}$ embodiment, except that this time it is the upper end 31 that is interlocked into the groove 15, rather than the lower end 30. The groove 15 is located higher up in the peripheral wall 10, at the level of the angle 17. The lower end 30 rests against the outer surface 14 of the peripheral wall 10.

Preferably, the body 2 and the wedging wall 3 are made from the same material, and the refill 1 can be recycled in a processing line dedicated to the material used. In other words, the refill 1 according this embodiment can be recycled in a single-material recycling system, as is becoming increasingly common.

Advantageously, the body 2 and the wedging wall 3 are made of polymer. For example, in polypropylene, polyethylene or recycled polypropylene. Or with bio-plastic techniques, chemical PCR (polymerase chain reaction) or mechanical PCR. Or PET (polyethylene terephthalate), POM (polyoxymethylene), PA PBT, TPE (thermoplastic elastomer), etc.

The manufacture of objects by a single injection method of these materials is known and mastered, so that they can be manufactured with different levels of hardness, deformability, breaking strength, etc. This allows to manufacture a refill 1 in which the body 2 and the wedging wall 3 are made of the same material. In addition to the fact that these materials can be easily adapted, they are inexpensive and suitable for packaging cosmetic products.

Although the body 2 and the wedging wall 3 are made of the same material, it is understood that the body 2 is rigid compared to the wedging wall 3 which is deformable and flexible. This is because the wedging wall 3 is thinner and can be deformed by the cavity 5 behind it. It's all about thickness and shape.

When the body 2 and the wedging wall 3 are made of different materials, the aforementioned materials can be used independently for one or the other.

These materials can be used with different levels of hardness and therefore deformability. Of course, in this description the terms "rigid" and "deformable" are used for simplicity's sake and according to the commonly accepted meaning.

Optionally, as shown in FIG. 2, the refill 1 also comprises a tongue 6 that can be used to grip the ring 3 or to prevent keying when the ring 3 is positioned.

In the following, the principle of assembly of the packaging pot according to the invention is described. Prior to assembly of the pot, the refill 1 is delivered with the wedging wall or walls 3 arranged around the body 2 in accordance with the invention. The user places the refill 1 in line with the upper opening of the receptacle 4, then gradually moves the refill 1 closer to the opening until the refill 1 is inserted into the receptacle 4. This insertion takes place along a mounting axis X aligned with the axis of symmetry of the refill 1 and the axis of symmetry of the receptacle 4. The refill 1 reaches its final position when the collar 16 rests on the neck 44. As the refill 1 approaches its final position, the user may feel a slight resistance resulting from the contact of the wedging wall or walls against the inner surface of the receptacle 4. The user will therefore have to apply slightly more pressure than hitherto in order for the wedging wall or walls 3 to deform to compensate for the clearance and for the refill 1 to reach its final position. The refill 1 can therefore be inserted into the receptacle 4 in a single movement, in a straight line.

To remove the refill 1, the user grips it by inserting a finger inside the empty refill and pressing the finger against the inner wall to lift it out. During removal, the wedging wall or walls 3 remain in position on the body 2, and are thus also removed with the refill 1.

The configurations shown in the cited figures are only possible examples, in no way limiting, of the invention which, on the contrary, encompasses the variations of shapes and designs within the reach of the person skilled in the art.

The invention claimed is:

1. A refill for a pot for packaging a cosmetic product, extending along a central axis X, capable of receiving the cosmetic product, and comprising a rigid body defined by a peripheral wall having an open upper end surrounded by a collar extending outwards, and a lower end closed by a bottom wall, wherein the refill comprises wedging means for wedging in the pot, which means are deformable and define, with an outer surface of the peripheral wall, at least one cavity of variable volume as a function of the wedging, wherein said wedging means comprises at least one external, flexible wedging wall arranged opposite and at least partially at a distance from the outer surface of the peripheral wall, said cavity being defined only between the wedging wall and the peripheral wall, wherein each wedging wall is curved and is mounted on the peripheral wall by interlocking of corresponding shapes, wherein the peripheral wall comprises a female form embodied in its outer surface, into which a male form provided for this purpose interlocks on the wedging wall, and wherein each wedging wall has an outwardly curved shape with a summit located at a distance from the peripheral wall, said male form projecting from a lower end of the wedging wall.

2. The refill according to claim 1, wherein each wedging wall has an upper end in contact with the body.

3. The refill according to claim 2, wherein the upper end of the wedging wall rests against the collar.

4. The refill according to claim 2, wherein the upper end of the wedging wall rests on the outer surface of the peripheral wall, in a vicinity of the collar.

5. The refill according to claim 2, wherein the upper end of the wedging wall rests in an angle formed between the peripheral wall and the collar.

6. The refill according to claim 1, further comprising a single wedging wall extending around an entire upper periphery of the body.

7. The refill according to claim 6, wherein the wedging wall consists of a removable ring.

8. The refill according to claim 1, further comprising several wedging walls evenly distributed around the body.

9. The refill according to claim 8, wherein each wedging wall extends over an angular sector of the body.

10. The refill according to claim 1, wherein the body and the wedging wall or walls are made of the same material.

11. A pot for packaging a cosmetic product, comprising a receptacle and a refill according to claim 1 inserted into the receptacle, the wedging means for wedging the refill being wedged against the receptacle so as to absorb a clearance existing between the refill and the receptacle.

* * * * *